US006655157B2

(12) United States Patent
McKiernan

(10) Patent No.: US 6,655,157 B2
(45) Date of Patent: Dec. 2, 2003

(54) WET PACKAGE PRECOOLER

(75) Inventor: Michael H. McKiernan, Fallbrook, CA (US)

(73) Assignee: The Rainbow Cooler Box Company, Fallbrook, CA (US)

( * ) Notice: Subject to any disclaimer, the term of this patent is extended or adjusted under 35 U.S.C. 154(b) by 11 days.

(21) Appl. No.: 10/223,679

(22) Filed: Aug. 20, 2002

(65) Prior Publication Data

US 2003/0037552 A1 Feb. 27, 2003

Related U.S. Application Data

(60) Provisional application No. 60/349,380, filed on Jan. 22, 2002, and provisional application No. 60/313,467, filed on Aug. 21, 2001.

(51) Int. Cl.[7] ..... F25D 13/06; F25D 25/04

(52) U.S. Cl. ..... 62/63; 62/380; 62/78; 62/150

(58) Field of Search ..... 62/63, 380; 221/78, 221/150

(56) References Cited

U.S. PATENT DOCUMENTS

| | | | | | |
|---|---|---|---|---|---|
| 3,658,304 | A | * | 4/1972 | Hall, Jr. et al. | 261/23 |
| 3,678,244 | A | * | 7/1972 | Worline | 219/388 |
| 3,785,276 | A | * | 1/1974 | Noor | 99/516 |
| 3,882,656 | A | * | 5/1975 | Lerner | 53/29 |
| 4,274,551 | A | * | 6/1981 | Hicks | 221/78 |
| 5,060,799 | A | | 10/1991 | De Pagter | |
| 5,073,401 | A | * | 12/1991 | Mohr | 426/658 |
| 5,404,797 | A | * | 4/1995 | Millar | 99/357 |
| 5,447,685 | A | * | 9/1995 | Sievert et al. | 422/22 |

OTHER PUBLICATIONS

Bartsch, James A. et al., "Refrigeration and Controlled Atmosphere Storage for Horticultural Crops", Northeast Regional Agricultural Engineering Service, p. 10, date unknown.

Newman, Julie et al., "Precooling Cut Flowers in 'Proconas' and Hampers", The Cut Flower Quarterly, Postharvest Issue, vol. 13, No. 3, Jul. 2001, 2 pages.

Procona® Product Brochure entitled "New! 'Florida', the Handy, Mini Procona Container!", Pagter Innovations b.v., date unknown.

Rij, Roger E. et al., "Handling, Precooling, and Temperature Management of Cut Flower Crops for Truck Transportation", U.S. Department of Agriculture, Science and Education Administration, Advances in Agricultural Technology, Jun. 1979.

Thompson, James F. et al., "Commercial Cooling of Fruits, Vegetables, and Flowers", University of California Publication 21567, 1998.

* cited by examiner

*Primary Examiner*—Timothy L. Maust
*Assistant Examiner*—Mark Shulman
(74) *Attorney, Agent, or Firm*—Nixon & Vanderhye P.C.

(57) ABSTRACT

A wet package precooler is operated inside a flower cooler room and includes a closed cabinet with a slotted opening in the top into which the flower packages slide. A conveyor on which the packages ride is provided inside the cabinet, a motor/blower assembly provides cooling air flow. By incorporating vertical cooling air flow, the machine cools the packaged flowers as they slide through the slot. The machine directs the cooling air into the top of the package, down through the flowers, and exhausts the air through hand holes and vents in the water container part of the package.

15 Claims, 2 Drawing Sheets

WET PACKAGE PRECOOLER

CROSS-REFERENCES TO RELATED APPLICATIONS

This application claims the benefit of U.S. Provisional Patent Application Serial No. 60/313,467, filed Aug. 21, 2001, and U.S. Provisional Patent Application Serial No. 60/349,380, filed Jan. 22, 2002, the entire contents of which are herein incorporated by reference.

STATEMENT REGARDING FEDERALLY SPONSORED RESEARCH OR DEVELOPMENT (Not Applicable)

BACKGROUND OF THE INVENTION

The present invention relates to the cooling of packaged flowers and, more particularly, to the cooling of packaged flowers using vertical air flow.

There are many references to the value and importance of removing heat from packaged flowers and lowering the temperature to near freezing. Product life is extended because the rate of respiration (heat generated by the flowers), the production of ethylene, the loss of moisture, and other effects of senescence are all slowed.

There are also proven processes for horizontally pre-cooling traditional dry packaged flowers. One method incorporates a horizontal tunnel cooler to direct the cooling air to the side of a Procona™ package. This method requires labor to position the packages on and off the pre-cooling equipment, and takes up valuable cooler space, neither of which shippers are willing to give over to the process.

It would thus be desirable to provide a low cost method of directing the air vertically through the packages, thereby using much less cooler space and very little handling.

BRIEF SUMMARY OF THE INVENTION

Using a vertical air flow method, the machine according to the present invention cools packaged flowers as they slide through a slot type precooler, which directs the cooling air into the top of the package, down through the flowers, and exhausting it through the hand holes and vents in the water container part of the package.

In an exemplary embodiment of the invention, a precooler system for packaged flowers includes a closed cabinet having a slotted opening in an upper surface, the slotted opening being sized to receive the packaged flowers. A conveyor is disposed in the closed cabinet that supports the packaged flowers. A blower assembly is positioned either remotely with a closed duct connection to the cabinet or below within the cabinet to supply/draw airflow substantially vertically through the packaged flowers from top to bottom. The system may additionally include structure for covering any portion of the slotted opening that is not occupied by packaged flowers. At least one angle bracket may be extended along the full length of corresponding edges of the slotted opening, the angle bracket guiding the packaged flowers through the slotted opening.

The system may additionally include at least one gasket extending across a corresponding edge of the slotted opening, the gasket providing a seal between the packaged flowers and the slotted opening. The slotted opening can be sized to accommodate standard size packaged flowers, wherein the system may further include an adapter shaped to fit in the slotted opening, the adapter being sized to accommodate smaller non-standard sized packaged flowers.

In another exemplary embodiment of the invention, a precooler system is provided for packaged flowers for operation within a flower cooler room. The precooler system includes a closed cabinet having a slotted opening in an upper surface, the slotted opening being sized to receive the packaged flowers; a conveyor disposed in the closed cabinet and supporting the packaged flowers; and a blower assembly positioned to supply airflow substantially vertically through the packaged flowers from top to bottom. The closed cabinet preferably includes sealing structure that provides a seal between the slotted opening and the packaged flowers.

In still another exemplary embodiment of the invention, a method of cooling packaged flowers is provided using the precooler system of the invention. The method includes (a) placing the packaged flowers in the slotted opening and on the conveyor; (b) moving the packaged flowers through the precooling system along the slotted opening via the conveyor; and (c) flowing conditioned air via the blower assembly substantially vertically through the packaged flowers from top to bottom.

BRIEF DESCRIPTION OF THE DRAWINGS

These and other objects and advantages of the present invention will be described in detail with reference to the accompanying drawings, in which.

DETAILED DESCRIPTION OF PREFERRED EMBODIMENTS

Figure 1:
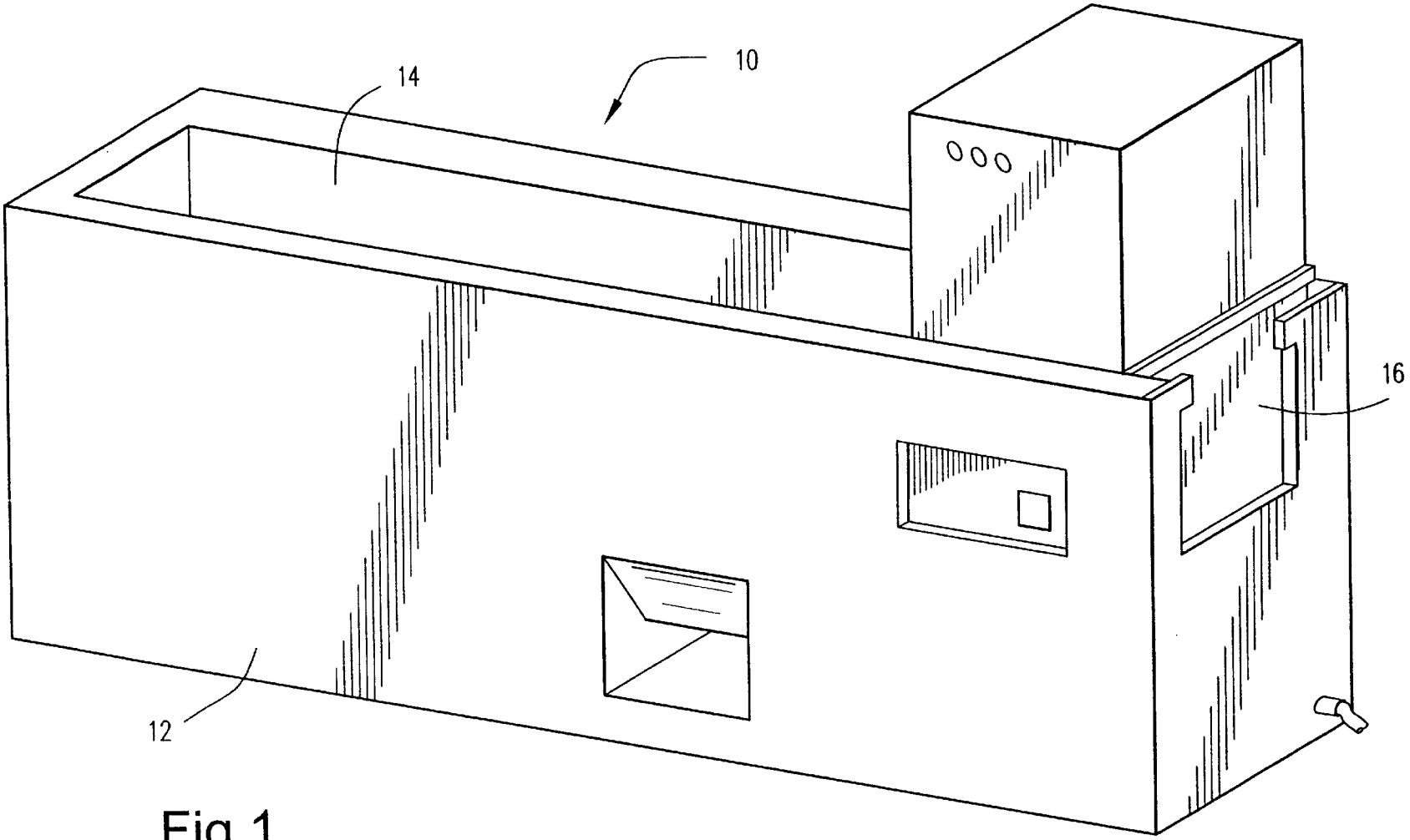
FIG. 1 is a perspective view of the wet package precooler according to the present invention.
Figure 2:
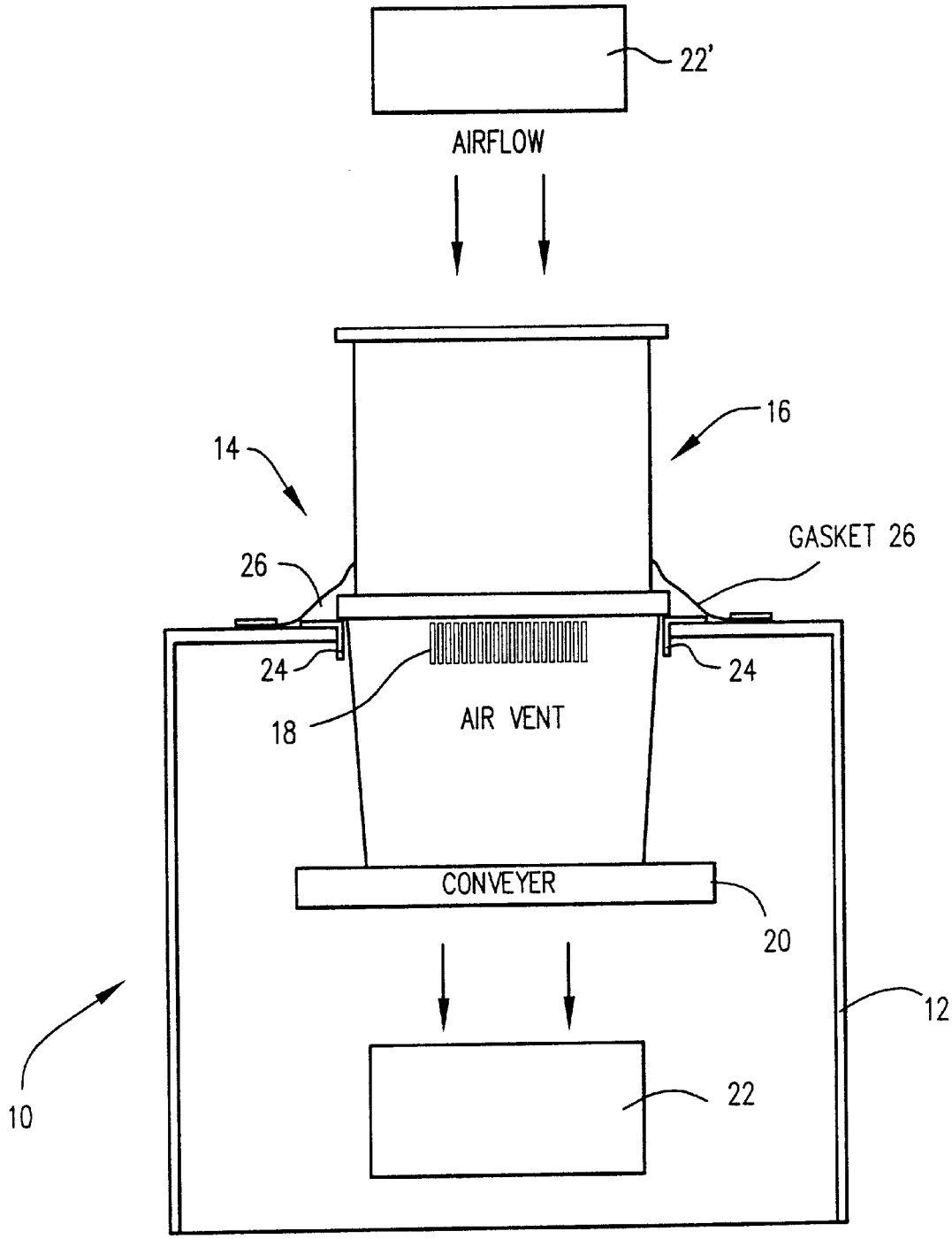
FIG. 2 is an end view of the precooler shown in FIG. 1.

With reference to FIGS. 1 and 2, the precooler machine 10 according to the present invention includes a generally closed cabinet 12 having a slotted opening 14 in the top. The slot 14 is generally sized to receive a conventional upright hamper 16, which is traditionally used for shipping flowers. An example of conventional packaging for flowers is described in U.S. Pat. No. 5,060,799. The upright hamper 16 typically includes at least one air vent 18 and two hand holes (not shown) on adjacent sides of the hamper 16. A conveyor 20 supports and transports the packages in the slot 14.

A motor/blower 22, 22' provides the cooling vertical air flow. As shown, the motor/blower assembly 22, 22' can be located inside the cabinet 12 as shown at 22 or ducted to or from the cabinet 12 from an exterior location as shown at 22'. Inside the cabinet 12, the motor/blower assembly 22 draws the cold cooler air through a plenum which in turn causes the air to pass over and around the packaged flowers, subsequently lowering the temperature of the flowers.

With continued reference to FIG. 2, metal angle brackets 24 cover an edge of the slot 14 to guide the container 16 smoothly through the slot 14. A gasket 26, preferably formed of a pliable plastic material, runs the full length of the slot 14 overlapping the edge of the containers 16 providing a seal. Reinforced tarpaulin covers or the like may be used to close over any portion of the slot 14 not occupied by packages 16, thereby stopping air flow bypass. Once the line of packages 16 fills the slot 14, such covers are not needed.

The machine can be built to accommodate any number or size of containers 16, and an adapter can be used so smaller containers will ride in the slot made for larger containers. The height of the packages is generally only limited by the flower cooler room in which the machine is placed. Mixed collar sizes can be used, which does not effect the flow or process. The slot 14 and conveyor 20 may also accommodate packages without ledges, assuming compatible air vent openings in the top and lower sides of the package.

The conveyor 20 can be made to abut any existing system and can be built to any height requirement, allowing continuous travel of the packages 16.

The machine is preferably operated inside a flower cooler room, thus preferably in a room with cool ambient air. Since pre-cooling is a relationship of temperature, time, mass, and specific heat, each individual unit can be exposed to the cooling process for as long as may be necessary depending on its weight and the density of the flowers it contains. The term "field heat" represents the cooling necessary to reduce the product from harvest temperature down to the safe storage level. The quantity of product harvested, the harvest temperature, and the rate of cooling all affect the field heat load. The field heat load can be determined according to:

$$Q_1 = MC\Delta T,$$

where $Q_1$ is the field heat removal rate (Btu/24 hrs), M is the mass of product cooled per 24 hours (lb), C is the specific heat of the product (Btu/lb° F.), and ΔT is the temperature drop of the product in 24 hours (° F.). A probe thermometer can be readily pushed into the side of a package and the unit removed when the desired temperature is obtained. This is an added advantage over traditional dry package precooling, where multiple units are cooled at one time, stored on carts or pallets and individual units are difficult to remove.

With the wet package precooler according to the present invention, typical flower cooler room cooling times, which can exceed twenty-four hours to attain proper temperatures, can be reduced to only 20–30 minutes, depending on the temperature and refrigeration capacity of the flower cooler. The machine utilizes controlled vertical air flow to cool packaged flowers. The machine is generally inexpensive to manufacture and can be easily positioned in the flower cooler room to facilitate storage and transfer of the packaged flowers.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A precooler system for packaged flowers comprising:

a closed cabinet having a slotted opening in an upper surface, the slotted opening being sized to receive the packaged flowers;

a conveyor disposed in the closed cabinet and supporting the packaged flowers in the slotted opening; and a blower assembly positioned to supply airflow substantially vertically through the packaged flowers from top to bottom.

2. A precooler system according to claim 1, further comprising cover means for covering any portion of the slotted opening that is not occupied by packaged flowers.

3. A precooler system for packaged flowers comprising:

a closed cabinet having a slotted opening in an upper surface, the slotted opening being sized to receive the packaged flowers;

a conveyor disposed in the closed cabinet and supporting the packaged flowers;

a blower assembly positioned to supply airflow substantially vertically through the packaged flowers from top to bottom; and at least one angle bracket extending along a corresponding at least one edge of the slotted opening, the at least one angle bracket guiding the packaged flowers through the slotted opening.

4. A precooler system according to claim 3, comprising two angle brackets extending along each edge of the slotted opening.

5. A precooler system for packaged flowers comprising:

a closed cabinet having a slotted opening in an upper surface, the slotted opening being sized to receive the packaged flowers;

a conveyor disposed in the closed cabinet and supporting the packaged flowers;

a blower assembly positioned to supply airflow substantially vertically through the packaged flowers from top to bottom; and at least one gasket extending across a corresponding at least one edge of the slotted opening, the at least one gasket providing a seal between the packaged flowers and the slotted opening.

6. A precooler system according to claim 5, comprising two gaskets extending across each edge of the slotted opening.

7. A precooler system according to claim 1, wherein the slotted opening is sized to accommodate standard size packaged flowers, the precooler system further comprising an adapter shaped to fit in the slotted opening, the adapter being sized to accommodate smaller non-standard sized packaged flowers.

8. A precooler system according to claim 1, wherein the blower assembly is disposed below the conveyor.

9. A precooler system for packaged flowers for operation within a flower cooler room, the precooler system comprising:

a closed cabinet having a slotted opening in an upper surface, the slotted opening being sized to receive the packaged flowers;

a conveyor disposed in the closed cabinet and supporting the packaged flowers; and a blower assembly positioned to supply ambient airflow from the flower cooler room substantially vertically directly through the packaged flowers from top to bottom, wherein the closed cabinet includes sealing structure that provides a seal between the slotted opening and the packaged flowers.

10. A precooler system according to claim 9, wherein the sealing structure comprises at least one gasket.

11. A precooler system according to claim 9, wherein the blower assembly is disposed below the conveyor.

12. A method of cooling packaged flowers using a precooler system including a closed cabinet having a slotted opening in an upper surface, the slotted opening being sized to receive the packaged flowers, a conveyor disposed in the closed cabinet and supporting the packaged flowers, and a blower assembly positioned to supply airflow substantially vertically through the packaged flowers from top to bottom, wherein the method comprises:

(a) placing the packaged flowers in the slotted opening and on the conveyor;

(b) moving the packaged flowers through the precooling system along the slotted opening via the conveyor; and (c) flowing conditioned air via the blower assembly substantially vertically through the packaged flowers from top to bottom.

13. A method according to claim 12, further comprising supporting the packaged flowers such that at least a portion thereof is disposed outside of the closed cabinet.

14. A precooler system for packaged flowers comprising:

a closed cabinet having a slotted opening in an upper surface, the slotted opening being sized to receive the packaged flowers;

a conveyor disposed in the closed cabinet and supporting the packaged flowers for movement through the precooler system along the slotted opening; and a blower assembly positioned to supply airflow substantially vertically through the packaged flowers from top to bottom.

15. A precooler system according to claim 1, wherein the conveyor is positioned relative to the slotted opening to support the packaged flowers with at least a portion thereof disposed outside of the closed cabinet.

* * * * *